US011553800B2

(12) United States Patent
Swearingen

(10) Patent No.: US 11,553,800 B2
(45) Date of Patent: Jan. 17, 2023

(54) MODULAR BEDROOM SYSTEM

(71) Applicant: Dorothy J. Swearingen, Hammondsville, OH (US)

(72) Inventor: Dorothy J. Swearingen, Hammondsville, OH (US)

( * ) Notice: Subject to any disclaimer, the term of this patent is extended or adjusted under 35 U.S.C. 154(b) by 173 days.

(21) Appl. No.: 17/187,832

(22) Filed: Feb. 28, 2021

(65) Prior Publication Data

US 2022/0273108 A1 Sep. 1, 2022

(51) Int. Cl.

| | |
|---|---|
| ***A47C 17/62*** | (2006.01) |
| ***A47B 83/04*** | (2006.01) |
| ***A47B 61/00*** | (2006.01) |
| ***A47C 19/20*** | (2006.01) |
| ***A47B 83/00*** | (2006.01) |
| ***A47C 19/22*** | (2006.01) |
| ***A47C 17/52*** | (2006.01) |

(52) U.S. Cl.

CPC ..... *A47C 17/62* (2013.01); *A47B 61/00* (2013.01); *A47B 83/00* (2013.01); *A47B 83/045* (2013.01); *A47C 19/207* (2013.01); *A47B 2200/04* (2013.01); *A47C 17/52* (2013.01); *A47C 19/20* (2013.01); *A47C 19/22* (2013.01)

(58) Field of Classification Search

CPC ..... A47C 17/62; A47C 19/207; A47C 19/22; A47C 17/86; A47C 19/20; A47C 17/52; A47B 61/00; A47B 83/045; A47B 83/00; A47B 2220/04

See application file for complete search history.

(56) References Cited

U.S. PATENT DOCUMENTS

| | | | |
|---|---|---|---|
| 3,157,889 | A | 11/1964 | Chanko |
| 3,338,648 | A | 8/1967 | Bannister |
| 5,163,968 | A | 11/1992 | Lafferty |
| 5,349,783 | A | 9/1994 | Jasperson et al. |
| 5,651,469 | A | 7/1997 | Lodge |
| 2003/0070224 | A1 | 4/2003 | Walsh |

FOREIGN PATENT DOCUMENTS

| | | | | | |
|---|---|---|---|---|---|
| CN | 102743045 | A | * | 10/2012 | ..... A47C 17/62 |
| GB | 2530248 | A | | 10/2014 | |
| JP | 2010279619 | A | * | 12/2010 | ..... A47C 17/62 |
| KR | 20100000637 | | * | 6/2008 | ..... A47C 19/22 |

* cited by examiner

*Primary Examiner* — David R Hare
*Assistant Examiner* — Madison Emanski
(74) *Attorney, Agent, or Firm* — Gwen R. Acker Wood; Acker Wood IP Law LLC

(57) ABSTRACT

The present invention provides a compact, comfortable modular bedroom system to be used as a living and sleeping space, which is especially valuable if one lives in small quarters, in a tiny home, or has a large family. The modular bedroom system is comprised of one or more closet units, desk units, drawer units, headboard units, and step units which are positioned adjacent to and attached to other units to provide a small, twin-size bed area, a large king-size or California king-size bed area, or areas which fall in-between, depending on the individual sizes of the units and how one configures the positioning of the units.

18 Claims, 15 Drawing Sheets

MODULAR BEDROOM SYSTEM

FIELD OF THE INVENTION

The present invention relates to modular furniture. In particular, the present invention relates to a compact, comfortable modular bedroom system comprised of individual units that are attached to one another for use as a sleeping and living space.

BACKGROUND OF THE INVENTION

A growing trend in recent years has been people downsizing from the conventional three to four bedroom house to much smaller homes, even tiny one-room dwellings. In one survey, over 50% of people in the United States said that they would consider living in a home that is less than 600 square feet, with millennials expressing even more interest— over 60% would consider living in a tiny home.

Statistics show that owners of tiny homes carry far less debt compared to the average American. Almost 90% percent of tiny house owners have less credit card debt than the average American; and over 50% percent have no credit card debt at all and have more savings than the average homeowner. In addition, almost 70% of tiny house owners do not have a mortgage, and homes beneath the 500-square-feet range have been appreciating twice as fast as the overall housing market.

There is, however, one obvious disadvantage to living in very small or tiny homes—lack of space. There is another disadvantage as well— lack of privacy if you live with other people, which can be stressful on relationships if you cannot get away from each other. Thus, a need exists to provide a unique solution to the lack of space, as well as lack of privacy people encounter when living in very small or tiny homes without sacrificing the enjoyment one derives from the coziness and intimacy of a very small dwelling.

SUMMARY OF THE INVENTION

The present invention fulfills this need by providing a modular bedroom system that provides a surprisingly comfortable sleep space, living space, or workspace, as well as ample storage space, all in a surprisingly small, compact system.

In an aspect of the invention, there is provided a modular twin-size bedroom system having a first end, a second end, a top end, and a bottom end. The modular twin-size bedroom system is comprised of a plurality of units, wherein each of the plurality of units is adjacent to and attached to another one of the plurality of units. The plurality of units comprises a closet unit, a desk unit, a drawer unit, a headboard unit, a rollable door, a step unit, and a bed floor.

The closet unit has a first side, a second side, a back side, a top side, and an opening therein. The desk unit has a first side, a second side, a back side, a top side, and an opening therein. The drawer unit has a front end, a top end, a first end, a second end, and a back end, wherein the drawer unit has a plurality of drawers atop one another on the front end. The headboard unit has a front end, a first end, a second end, and a back end. The step unit is comprised of a plurality of rectangular boxes placed atop one another, wherein each of the plurality of rectangular boxes has one or more open sides.

In one embodiment, the first side of the desk unit is attached to the second side of the closet unit; the back end of the drawer unit is attached to the first side of the closet unit, the step unit is located adjacent to the second end of the drawer unit, and the headboard lies atop the desk unit and is attached thereto. The rollable door is configured to roll from the first side of the closet unit to the second side of the desk unit in order to cover the opening in the closet unit or the desk unit. Attached to the top of the door are a set of rollers, wherein the rollers are movable along a channel located at the top of the closet opening and the desk opening. The bed floor is configured to accommodate a bed mattress, wherein the bed floor is comprised of the top sides of the desk unit, the closet unit and the drawer unit.

The invention contemplates other embodiments, including, without limitation, two desk units adjacent to and attached to each other, or two closet units adjacent to and attached to one another.

In another aspect of the invention, there is provided a modular king-size bedroom system. The modular king-size bedroom system is comprised of the back end of one modular twin-size bedroom system placed adjacent to and attached to the back end of a mirror image of the modular twin-size system, the modular king-size bedroom system having a top end, a bottom end, a first end, and a second end.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting and are not necessarily drawn to scale.

DETAILED DESCRIPTION OF THE INVENTION

Figure 1:
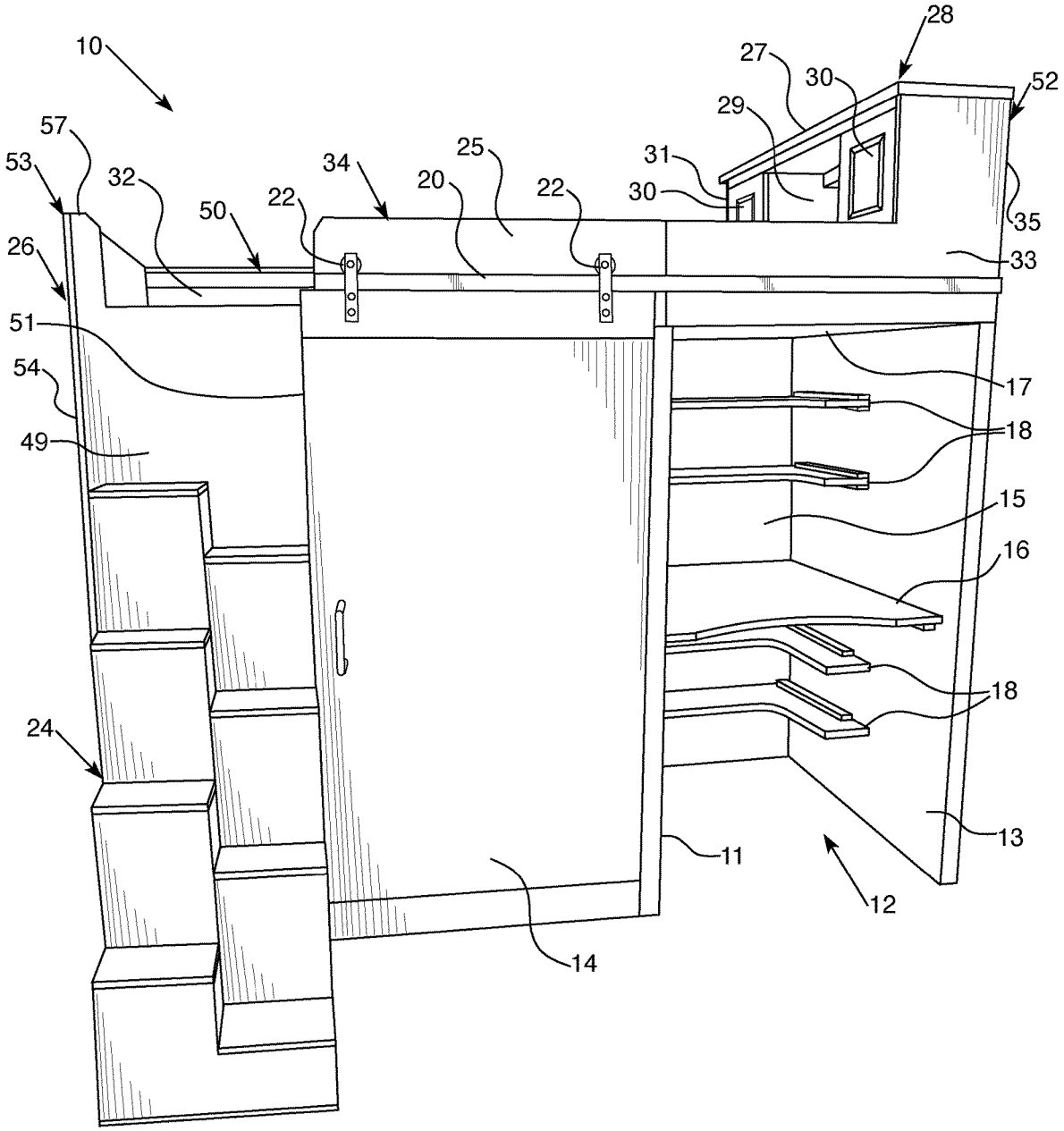
FIG. 1 is a front perspective view of the modular twin-size bedroom system showing the desk unit with the door covering the closet unit, in accordance with an embodiment of the present invention.

Referring now to FIGS. 1-11, in one embodiment of the invention there is provided a modular twin-size bedroom system 10 having a front end 34, a back end 50, a top end 52 and a bottom end 53.

As shown in FIGS. 1-4, the modular twin-size bedroom system 10, having a front end 34, a back end 50, a top end 52 and a bottom end 53, is comprised of a closet unit 36 having a first side 37, a second side 39, a back side 41, a top side 45, and an opening therein. Adjacent to and attached to the closet unit 36 is a desk unit 12 having a first side 11, a second side 13, a back side 15, a top side 17, and an opening therein. The first side 11 of the desk unit 12 is attached to the second side 39 of the closet unit 36. Attached to the first side 37 of the closet unit 36 is a drawer unit 26 having a front end 54, a top end 57, a first end 47, a second end 49 and a back end 51. On the front end 54 of the drawer unit 26 are a plurality of drawers 46 inserted therein. The back end 51 of the drawer unit 26 is attached to the first side 37 of the closet unit 36. A headboard unit 28, having a front end 27, a first end 31, a second end 33, and a back end 35, is positioned at the top end 52 of the modular twin-size bedroom system on the top side 17 of the desk unit 12 and is attached thereto. Adjacent to and attached to the second end 33 of the headboard unit 28 is an extension panel 25 that lies atop and is attached to the top side 45 of the closet unit 36.

Figure 2:
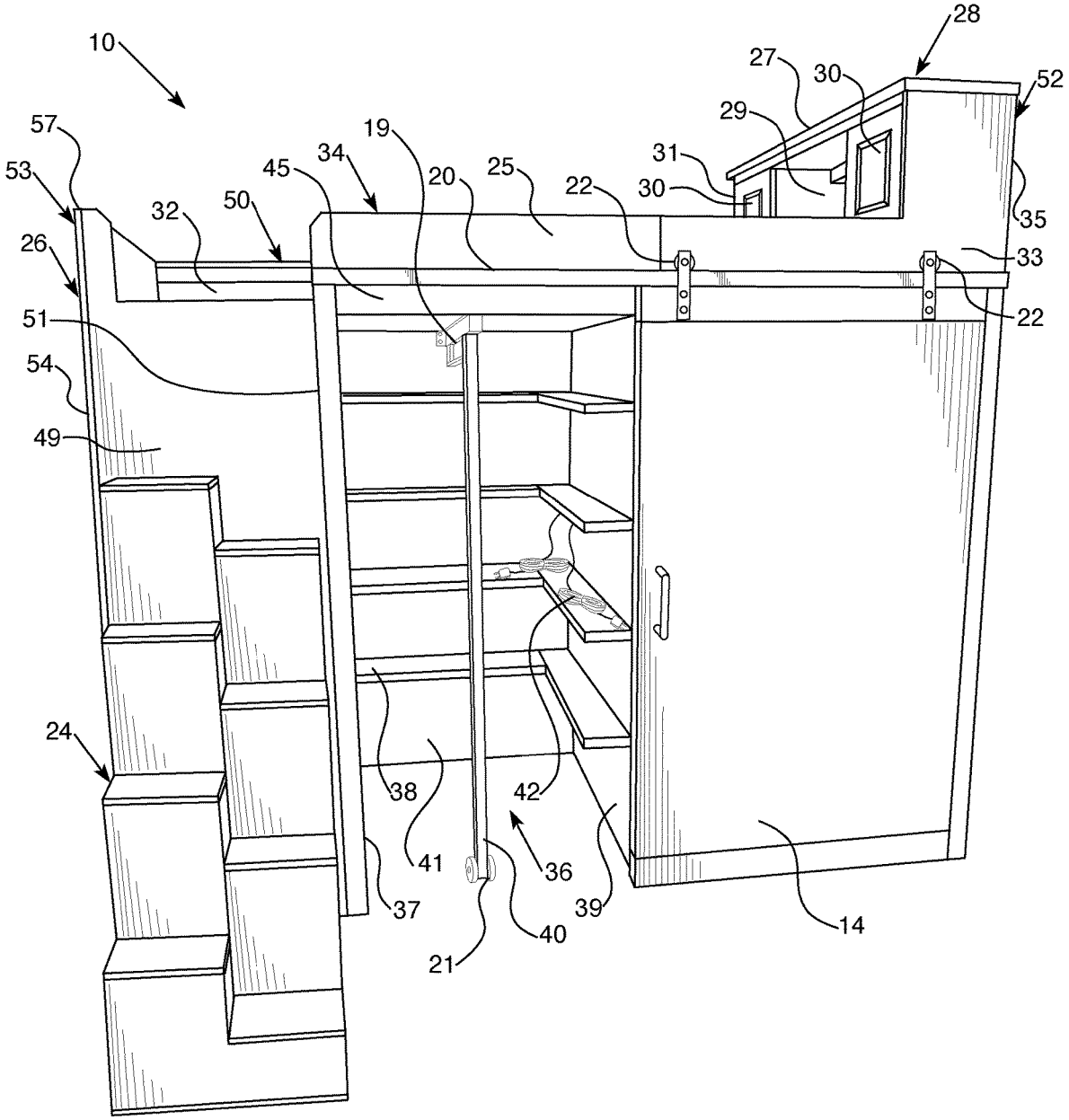
FIG. 2 is a front perspective view of the modular twin-size bedroom system showing the closet unit and the door covering the desk unit, in accordance with an embodiment of the present invention.

Positioned in front of the closet unit 36 and the desk unit 12 is a moveable door 14 that moves horizontally from the first side 37 of the closet unit 36 to the second side 13 of the desk unit 12 to cover the opening in the closet unit 36 or the desk unit 12 (best shown in FIGS. 1 and 2). Located at the top of the moveable door 14 and attached thereto is a set of rollers 22. A roller channel 20 spans across the extension panel 25 and the second end 33 of the headboard unit 28. The rollers 22 are configured to move along the channel 20 when the moveable door 14 is moved horizontally.

Figure 3:
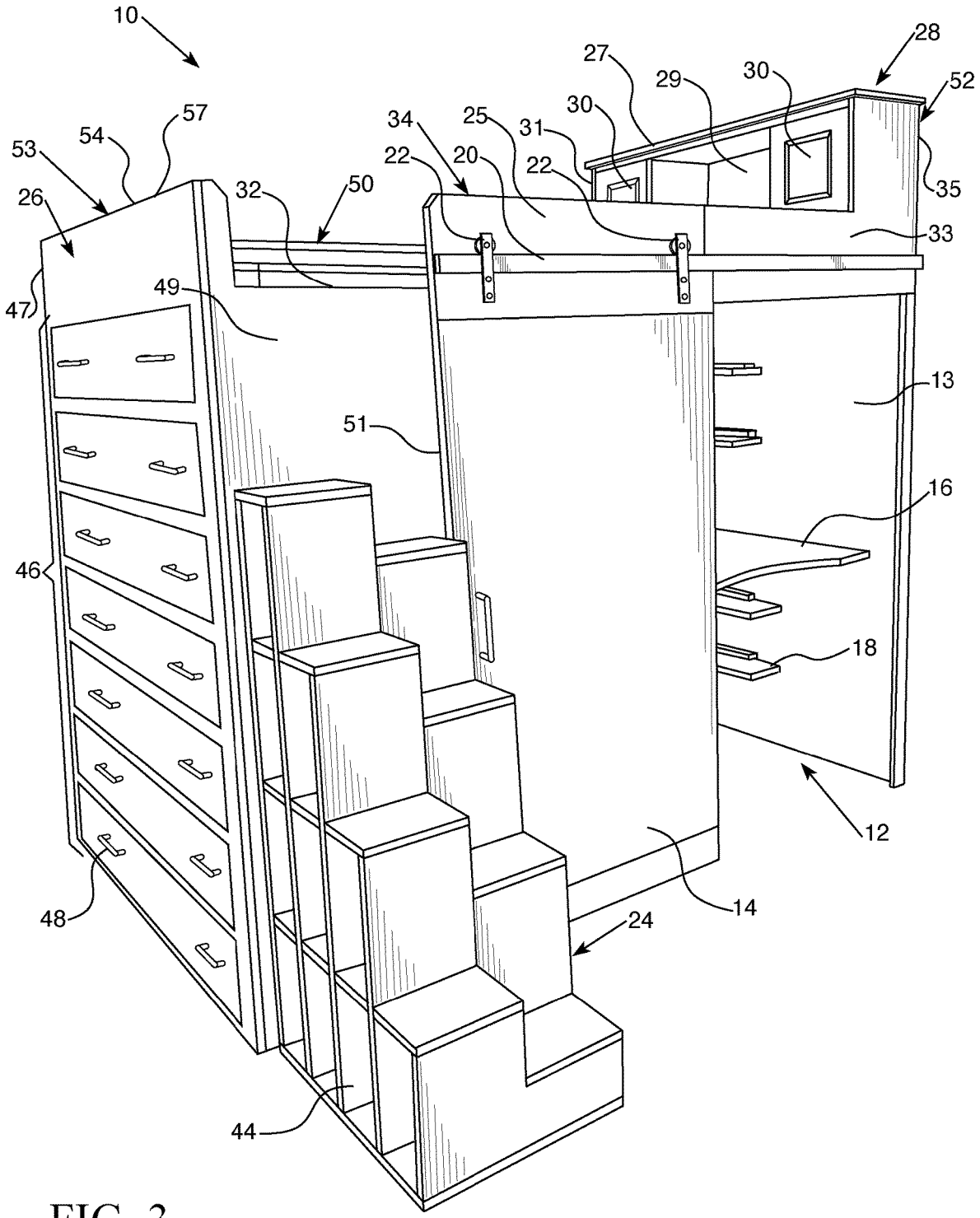
FIG. 3 is a perspective view of the modular twin-size bedroom system showing the drawer unit, the door covering the closet unit, and the step unit, in accordance with an embodiment of the present invention.
Figure 4:
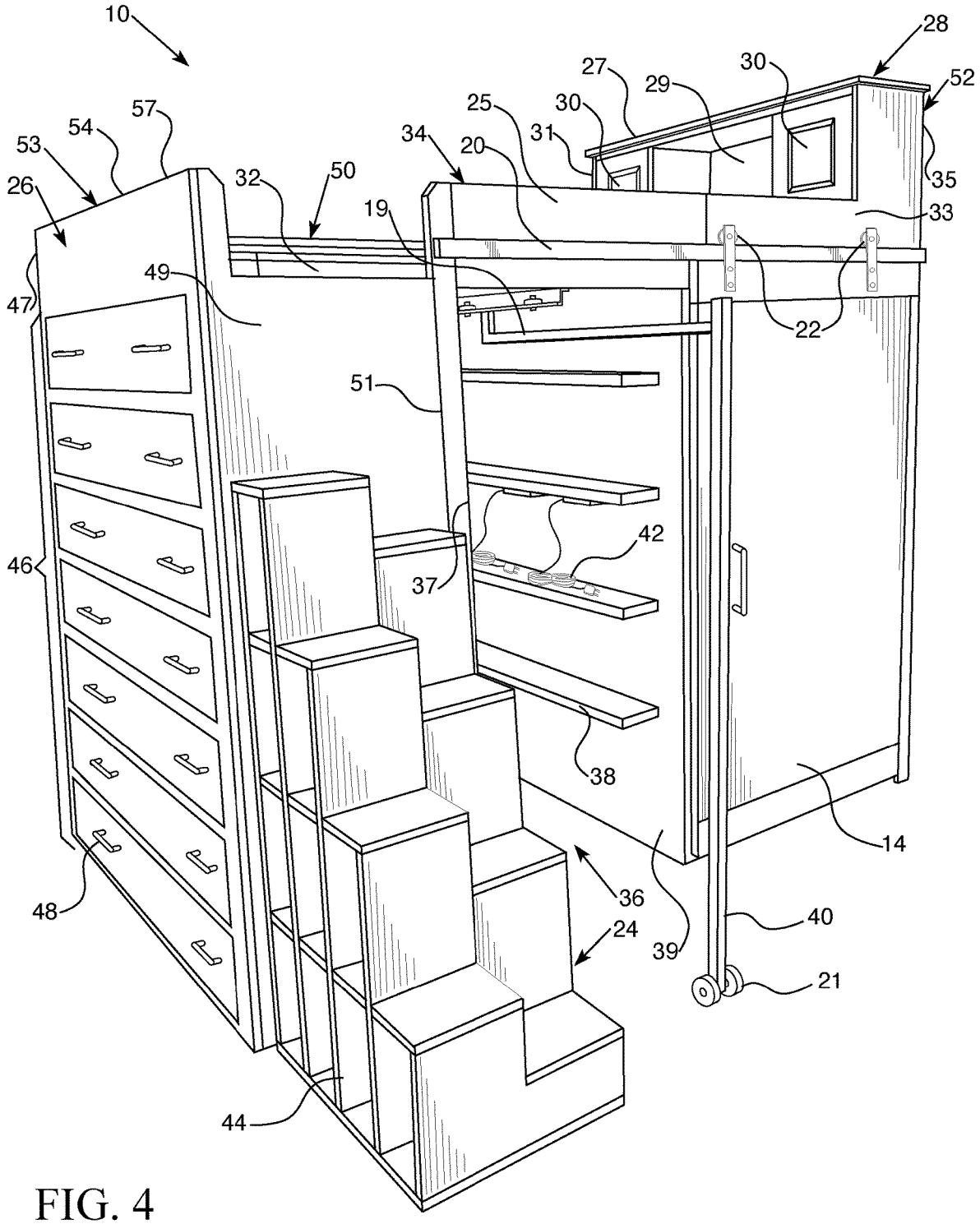
FIG. 4 is a perspective view of the modular twin-size bedroom system showing the drawer unit, the step unit, the door covering the desk unit, and the movable closet rack extended out of the closet unit, in accordance with an embodiment of the present invention.
Figure 6:
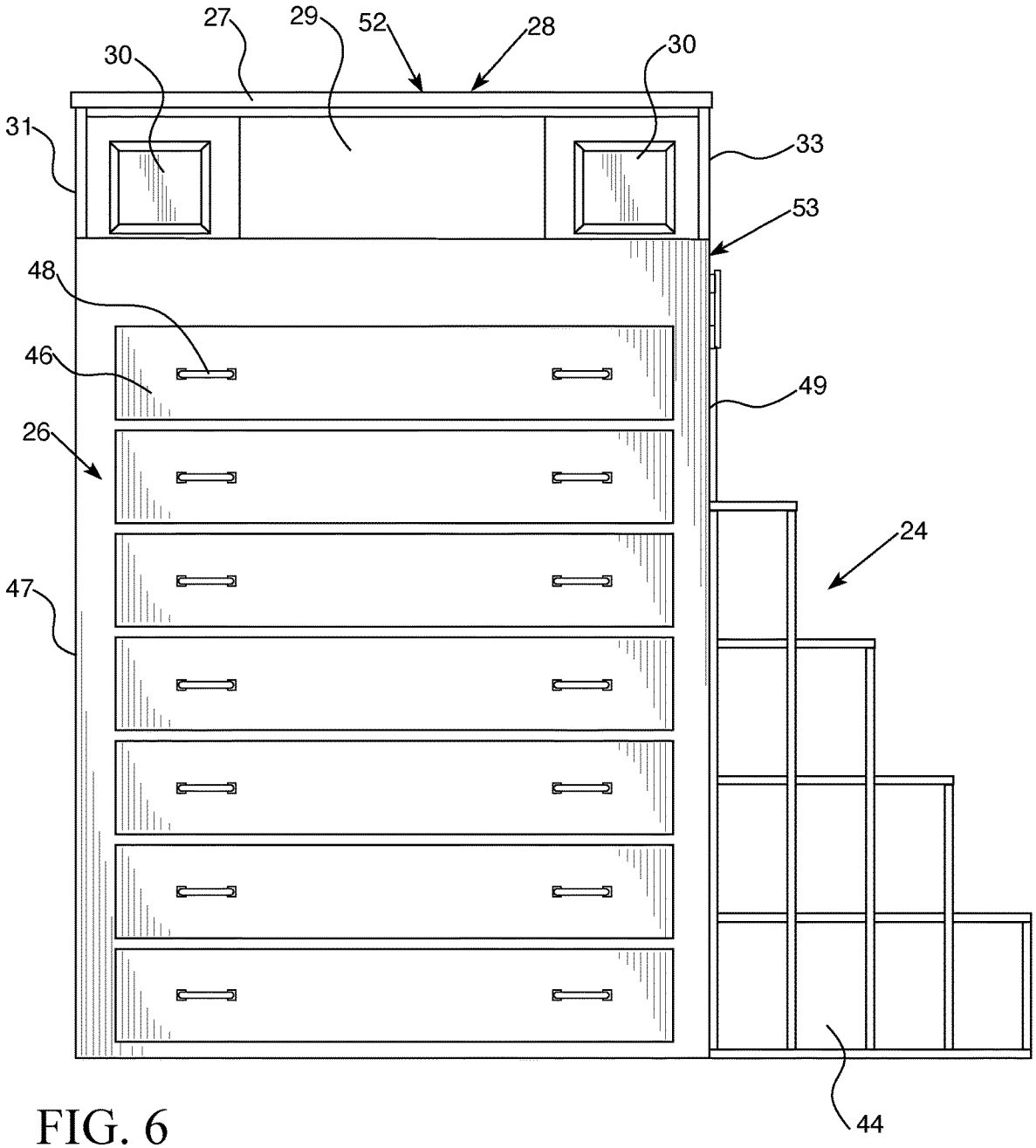
FIG. 6 is a left side view of the modular twin-size bedroom system, in accordance with an embodiment of the present invention.

Adjacent to the second end 49 of the drawer unit 26 is a step unit 24 comprised of a plurality of rectangular boxes, each box having one or more open sides 44 for storage of shoes or other items (best shown in FIGS. 3, 4 and 6).

Figure 5:
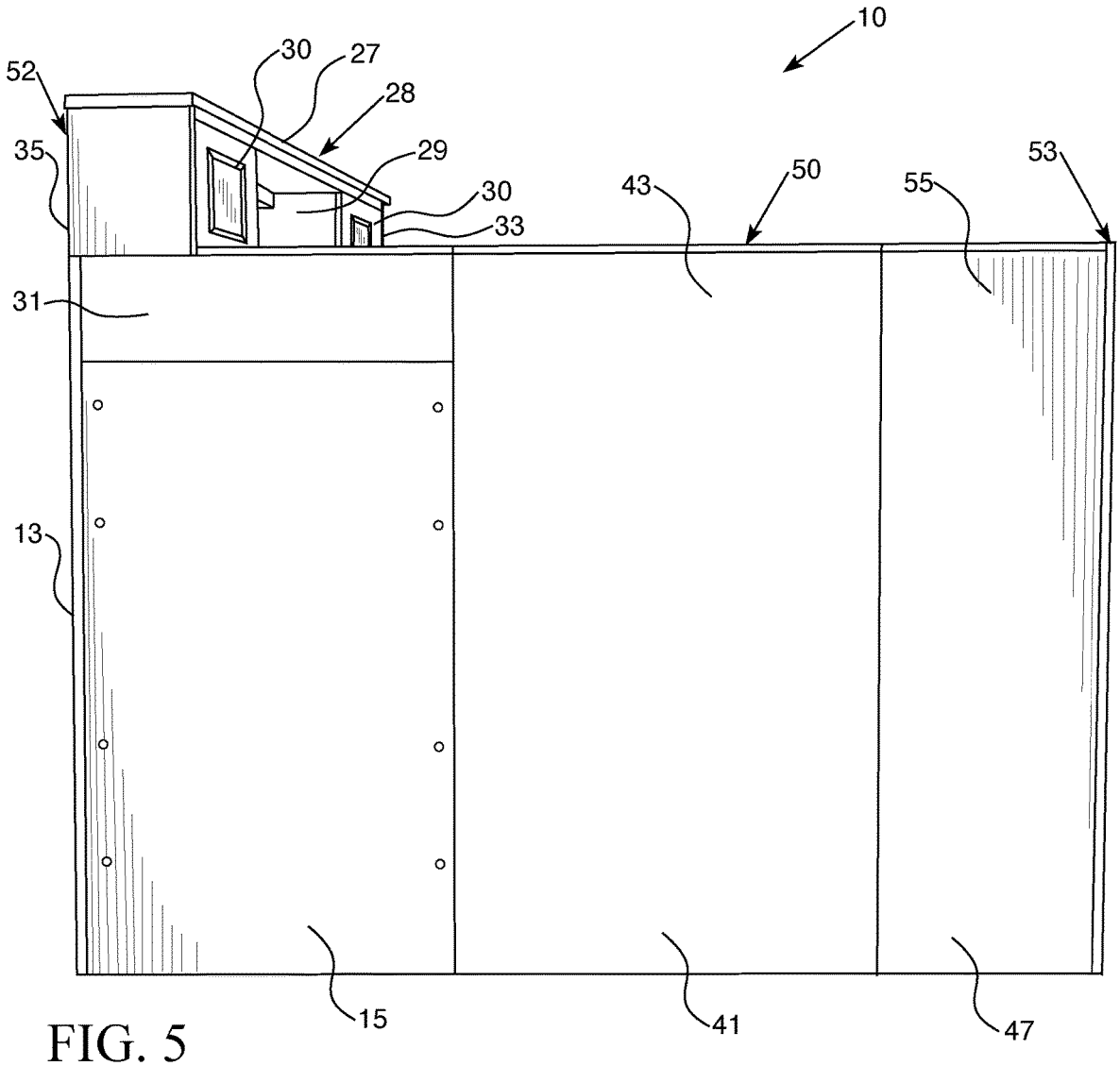
FIG. 5 is a back perspective view of the modular twin-size bedroom system, in accordance with an embodiment of the present invention.

As shown in FIG. 5, the back end 50 of the modular twin-size bedroom system 10 is comprised of the back side 15 of the desk unit 12, the first end 31 of the headboard unit 28, the back side 41 of the closet unit 36, and the first end 47 of the drawer unit 26.

FIG. 6 shows a front view of the bottom end of the modular twin-size bedroom system 10, comprised of the drawer unit 26 having a plurality of drawers 46 therein, with each drawer having a drawer pull 48 for opening and closing the drawers 46. From this vantage point, the top end 52 of the modular twin-size bedroom system 10 can be seen, which comprises the headboard unit 28. In an embodiment, the headboard unit 28 has a recessed area 29 which can be used for storage, such as books and other items, and contains two moveable panels 30 near its first end 31 and its second end 33.

Figure 7:
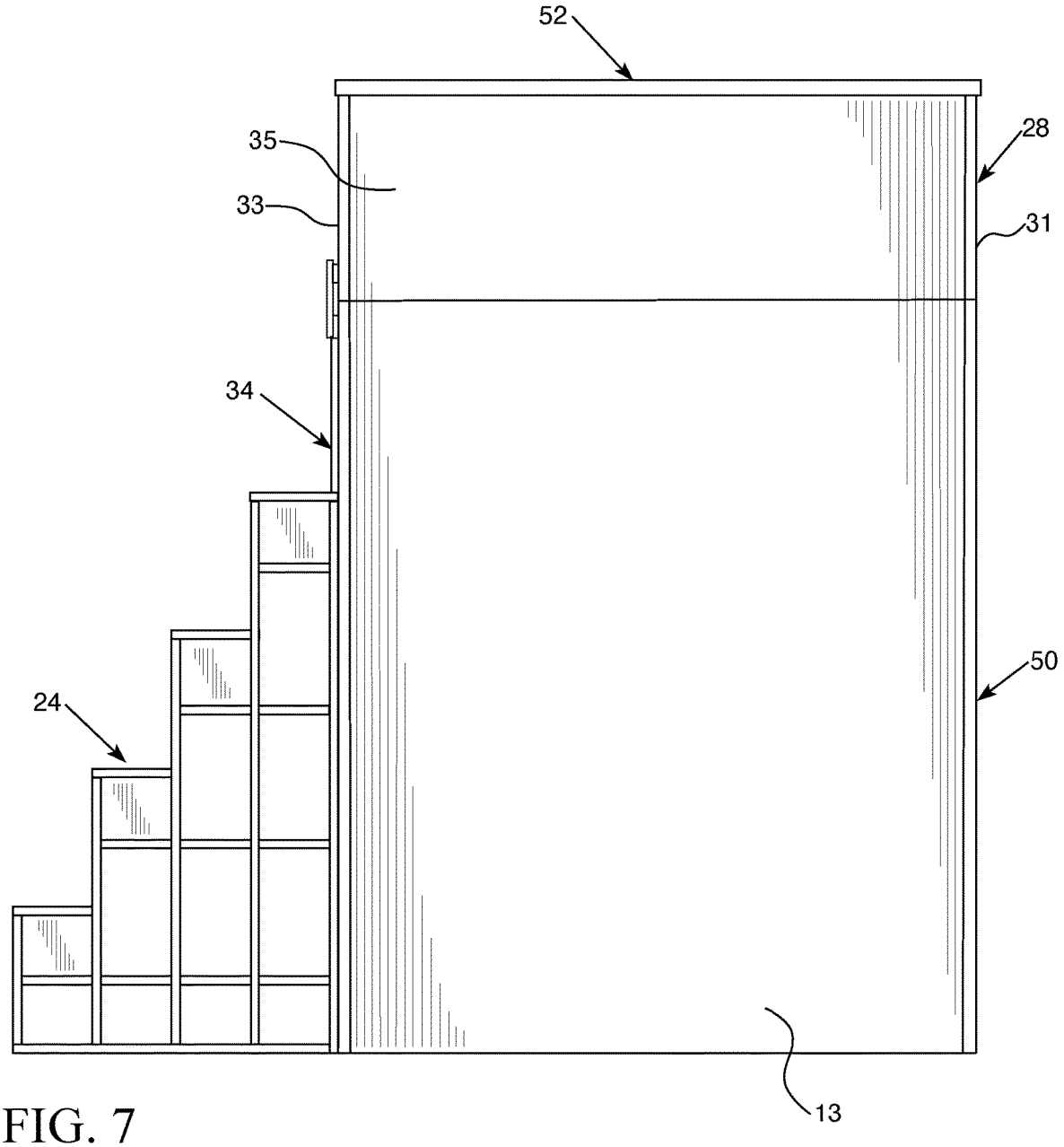
FIG. 7 is a right side view of the modular twin-size bedroom system, in accordance with an embodiment of the present invention.

FIG. 7 shows a front view of the back of the top end 52 of the modular twin-size bedroom system 10. The upper part is comprised of the back end 35 of the headboard unit 28, and the lower part is comprised of the second end 13 of the desk unit 12. Also seen from this vantage point is the step unit 24.

Figure 8:
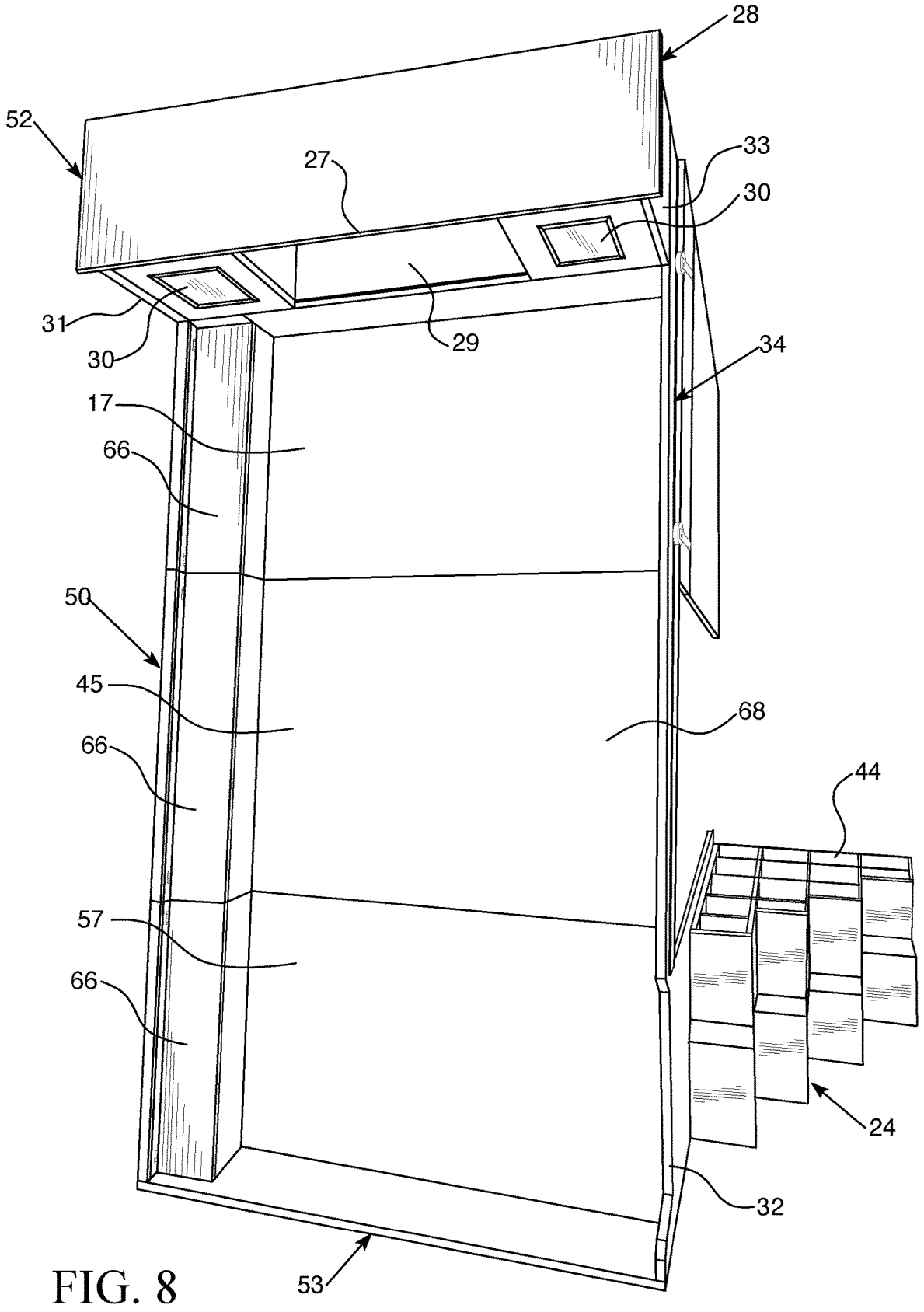
FIG. 8 is a top perspective view of the modular twin-size bedroom system, in accordance with an embodiment of the present invention.
Figure 9:
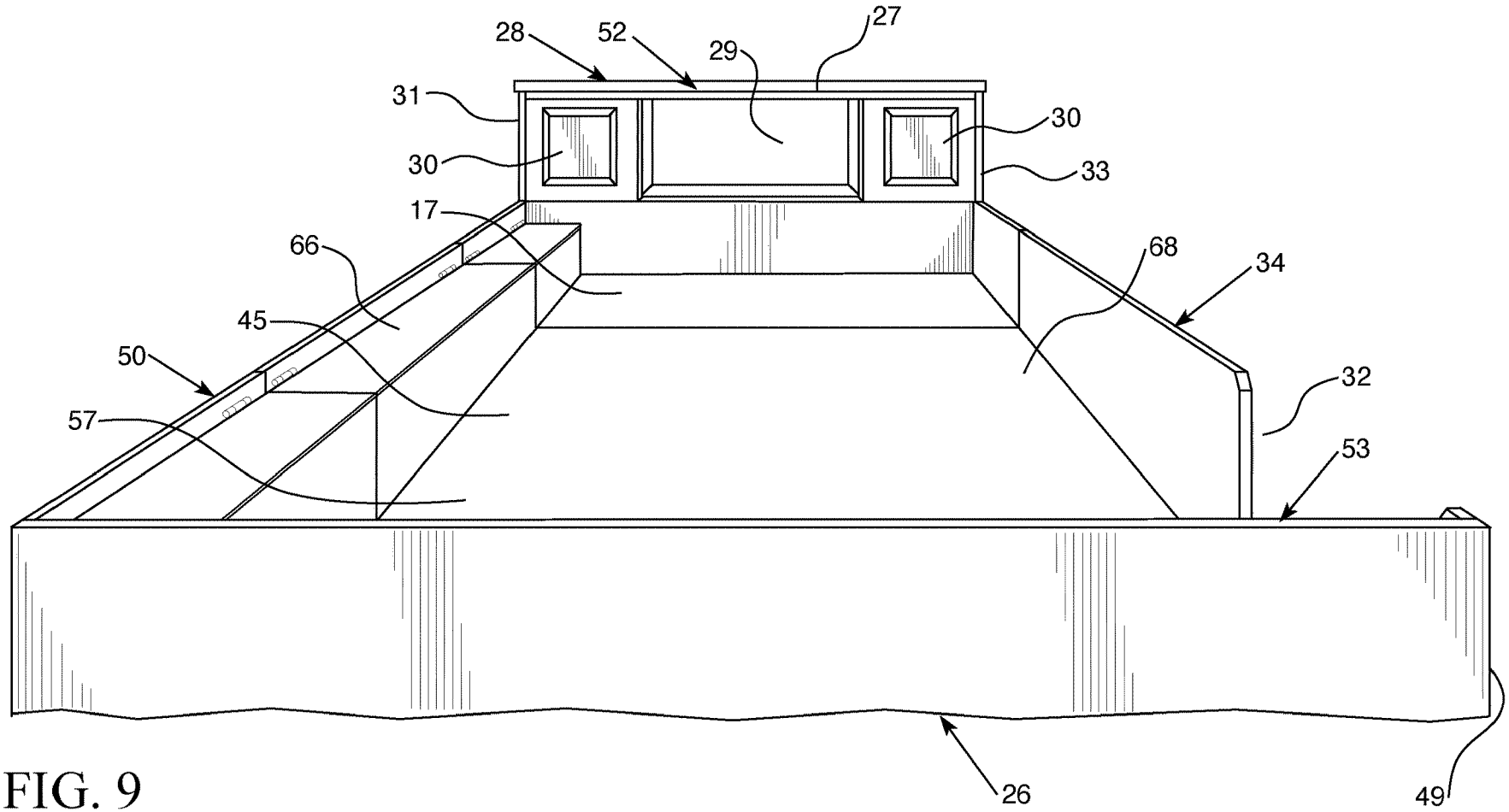
FIG. 9 is a partial, left perspective view of the modular twin-size bedroom system, in accordance with an embodiment of the present invention.

A bed floor 68 that is configured to accommodate approximately a twin-size bed mattress is shown in FIGS. 8 and 9. As shown in FIG. 8, the bed floor 68 comprises the top end 57 of the drawer unit 26, the top side 45 of the closet unit 36, and the top side 17 of the desk unit 12. The bed floor 68 includes a plurality of ledges 66, each having an interior which may be used for storage. A moveable panel is attached to each ledge to allow access and to cover the interior of each ledge 66. The ledges 66 may be positioned either on the back end 50 or the front end 34 of the bed floor 68. In an embodiment, as shown in FIGS. 8 and 9, the ledges 66 are positioned on the back end 50 of the bed floor 68. Also shown is a recessed area 32 at the top of the second end 49 of the drawer unit 26 (best shown in FIG. 9), which allows one entry onto the bed floor 68. The invention contemplates that one uses the step unit 24 to ascend up to the recessed area 32 to enter onto the bed floor 68.

Figure 10:
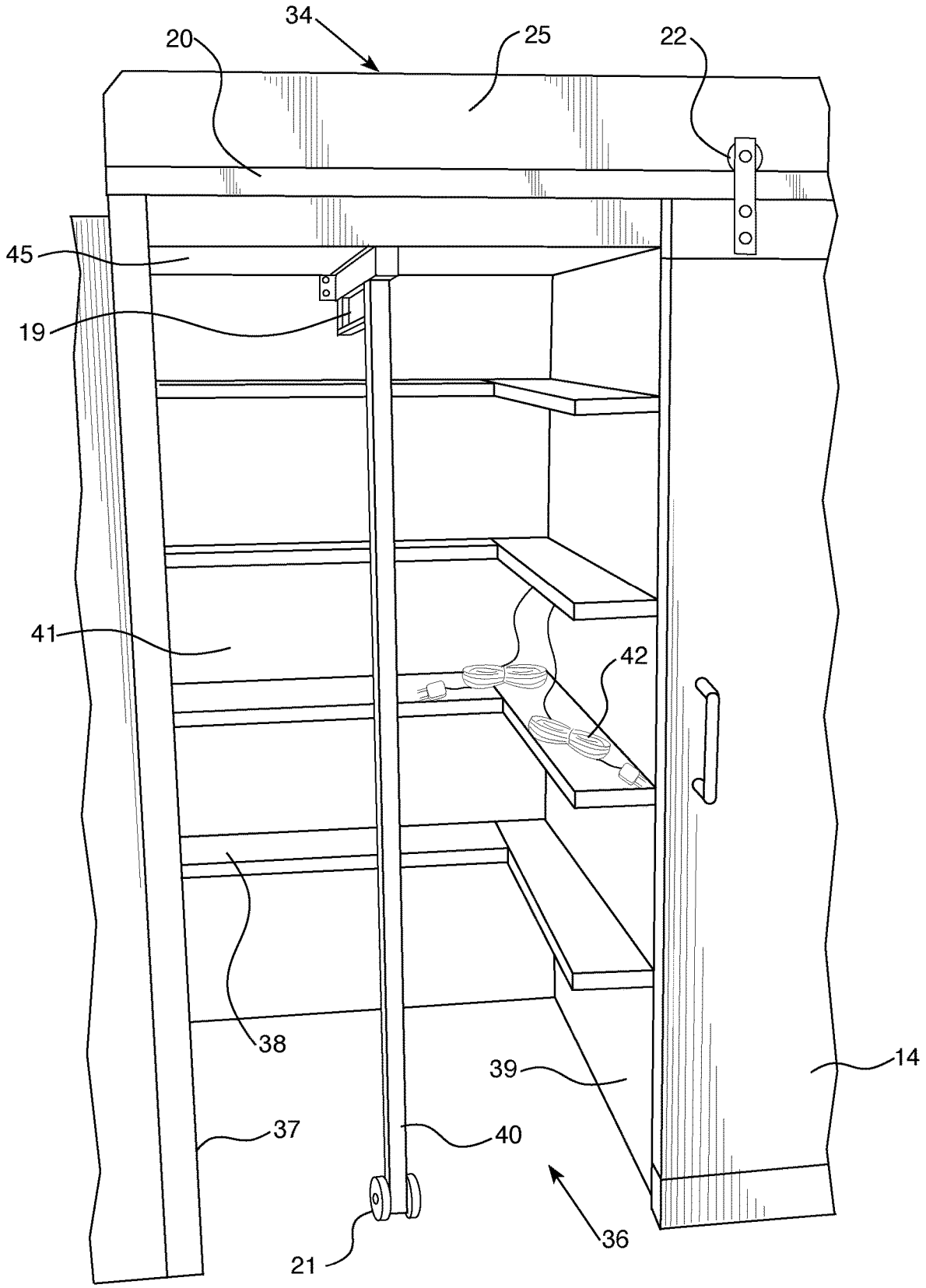
FIG. 10 is a perspective view of the closet unit, in accordance with an embodiment of the present invention.

As shown in FIG. 10, the closet unit 36 includes a plurality of shelves 38 positioned on the sides of the closet unit 36. The invention contemplates any number of shelves 38 which can be positioned according to the preference of a user. Also included is a moveable closet rack 40 in which one end is attached to the top side 45 of the closet unit 36 and includes a clothing rack 19 for hanging closet and other items, and the other end has a roller 21 attached thereto for moving the clothes rack 40 into and out of the closet unit 36. Also shown are a plurality of electrical plugs 42 for use in electrical outlets (not shown) placed in various areas of the modular bedroom system, such as in the closet unit 36, the desk unit 12, near the headboard unit 28, and in other areas where lighting or electrical power is desired.

Figure 11:
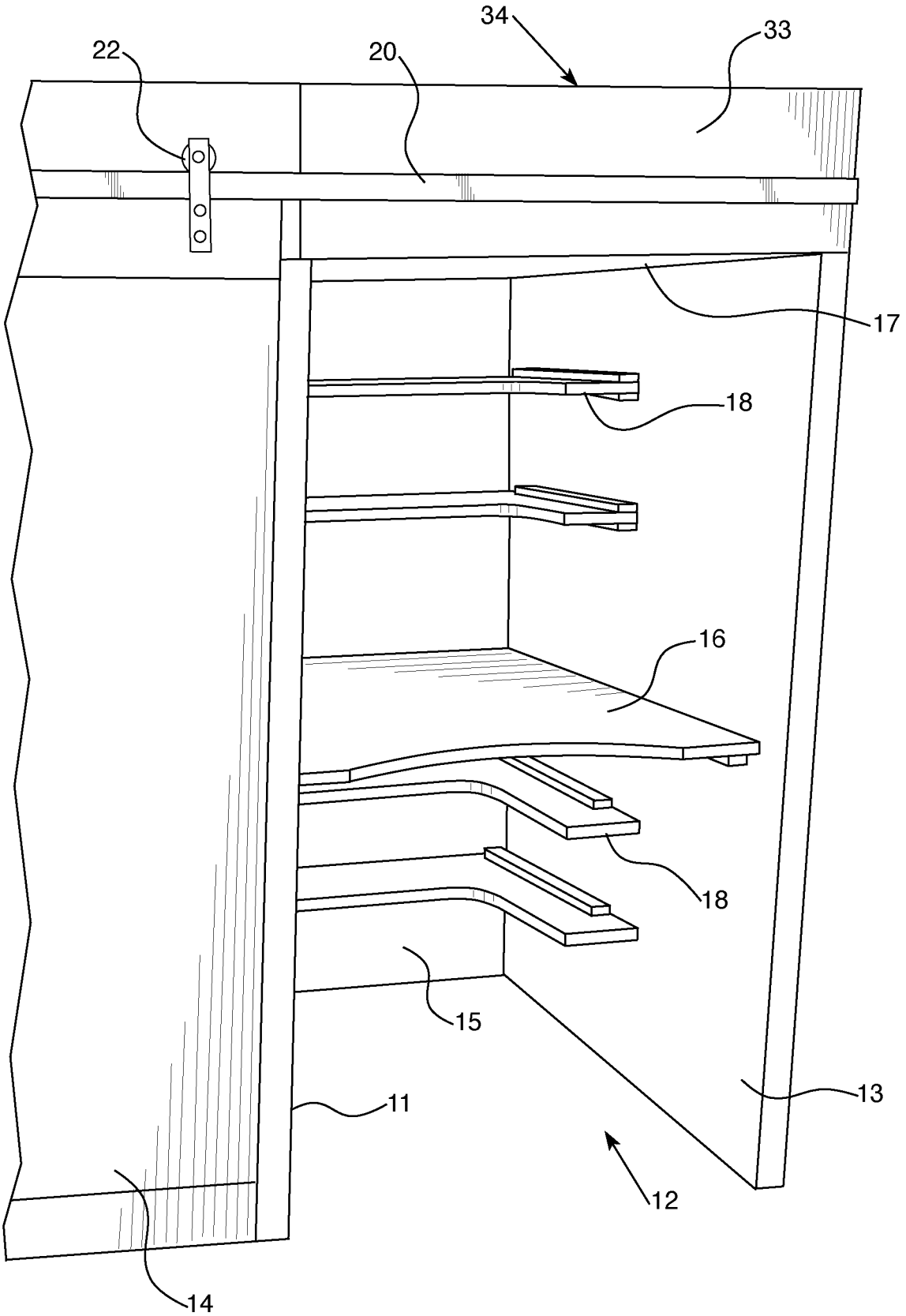
FIG. 11 is a perspective view of the desk unit, in accordance with an embodiment of the present invention.

As shown in FIG. 11, the desk unit 12 includes a desktop 16 for use with a computer or any other items a user may want to place atop a desktop, and a plurality of desk unit shelves 18 positioned on the first side 11, second side 13, and back side 15 of the desk unit 12. Here, too, there may be any number of shelves, positioned according to the user's preference. In addition, the desktop 16 may be positioned at any height to accommodate the user's size.

In another embodiment of the invention, there is provided a modular king-size bedroom system 100, as shown in FIGS. 12-15.

Figure 15:
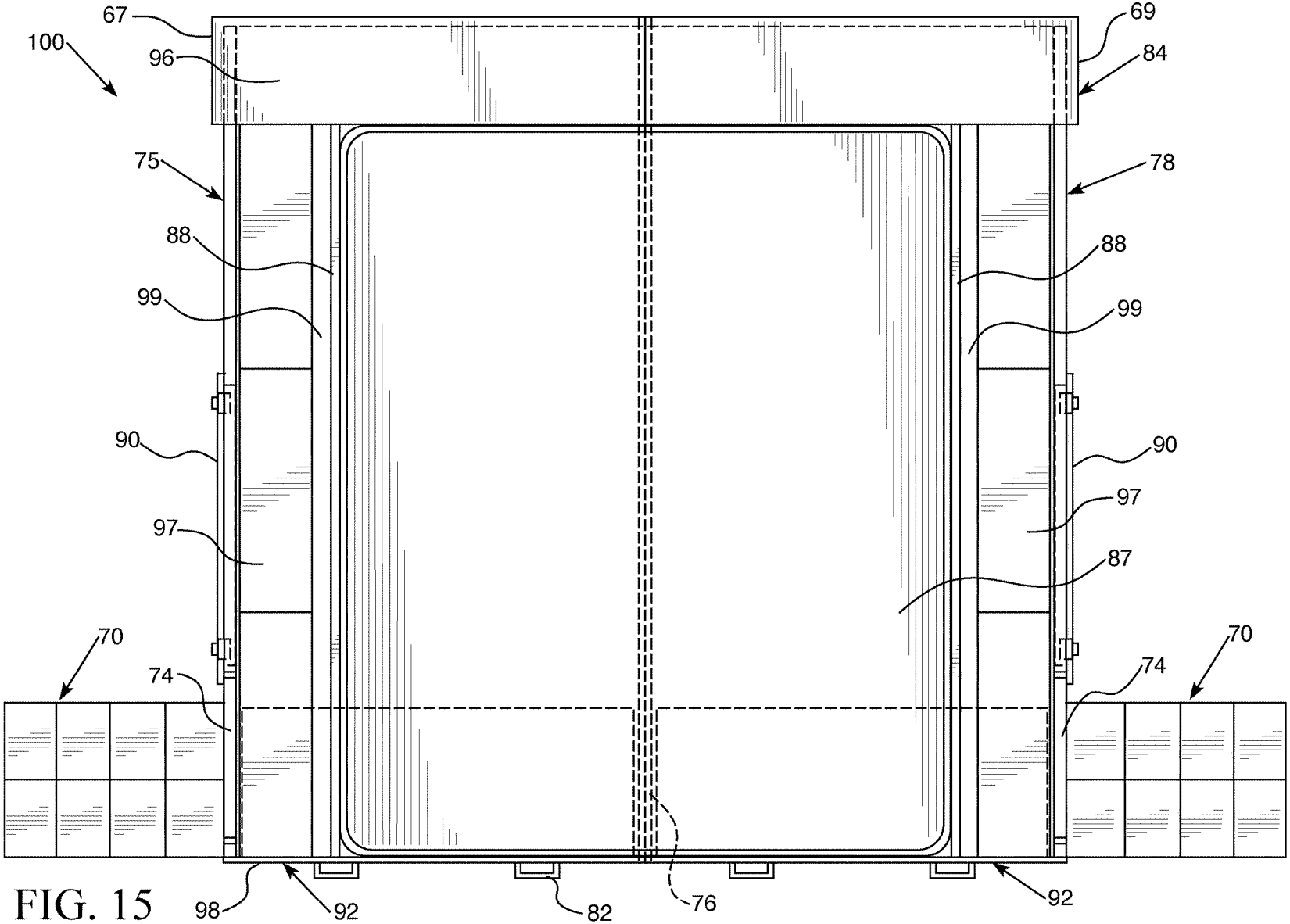
FIG. 15 is a top view of the modular king-size bedroom system, in accordance with an embodiment of the present invention.

The modular king-size bedroom system 100 comprises placing and then attaching the back end 76 of one modular twin-size bedroom system 10 adjacent to the back end 76 of a mirror image of the modular twin-size bedroom system 10. As shown in FIG. 15, the resulting modular king size bedroom system 100 has a top end 96, a bottom end 98, a first end 75, and a second end 78. Each of the modular twin-size bedroom systems which are placed adjacent to one another can be envisioned in FIGS. 12 and 13, respectively, which shows the second end 78 (FIG. 12) and the first end 75 (FIG. 13) of the modular king-size bedroom system 100.

As shown in FIG. 15, the king-size modular bedroom system 100 includes a king-size bed floor 99. In order to provide this space using the back to back twin-size modular bedroom systems 10, the first ends 31 of the headboard unit 28, the tops 43 of the two back sides 41 of the closet units 36, and the tops 55 of the first ends 47 of the drawer units 26 are removed from the two modular twin-size bedroom systems 10. These portions which are removed are best shown in FIG. 5.

Figure 12:
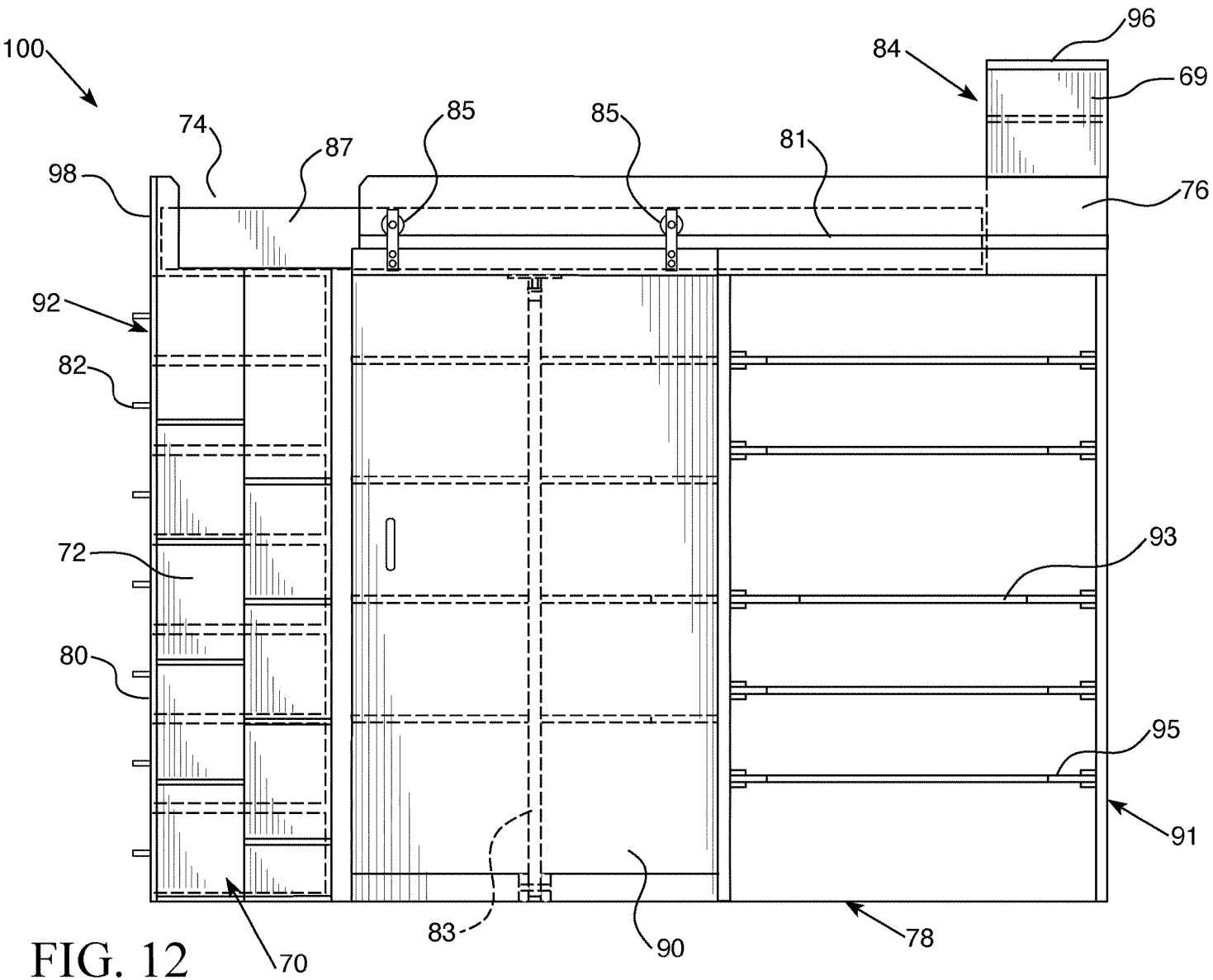
FIG. 12 is a right side view of a modular king-size bedroom system, in accordance with an embodiment of the present invention.
Figure 13:
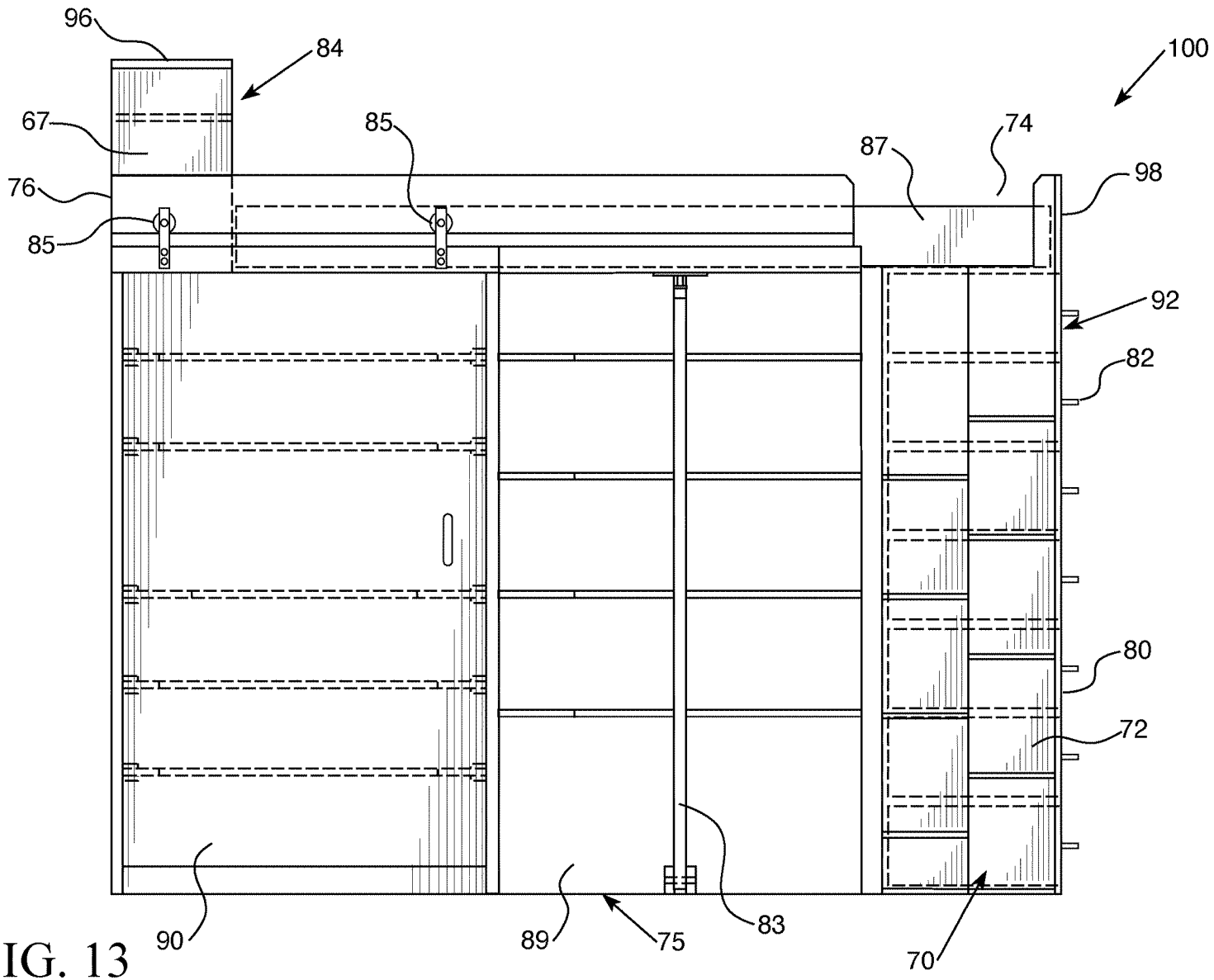
FIG. 13 is a left side view of the modular king-size bedroom system, in accordance with an embodiment of the present invention.
Figure 14:
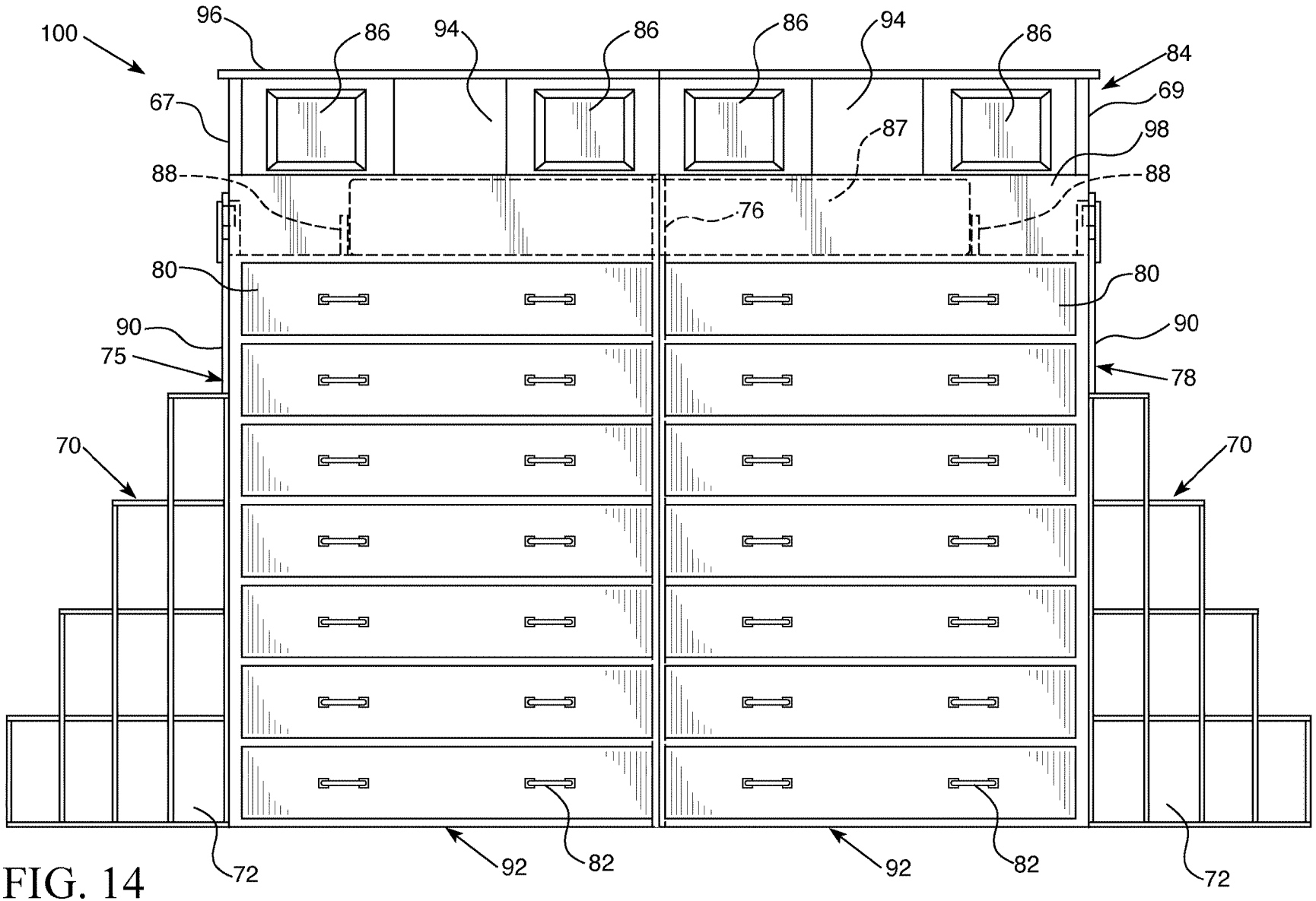
FIG. 14 is a bottom end view of the modular king-size bedroom system, in accordance with an embodiment of the present invention.

As shown in FIGS. 12-14, the modular king-size bedroom system 100 of the invention therefore comprises two desk units 91, each having a desktop 93 and shelves 95; two closet units 89, each having a moveable clothes rack 83; two moveable doors 90, each having door rollers 85; two step units 70 with storage spaces 72 therein; two drawer units 92, each having drawers 80 and drawer pulls 82; and a headboard unit 84 from the two modular twin-size bedroom systems 10, the headboard unit 84 having two panels 86 and a recessed area 94 between the two panels 86.

As shown in FIGS. 12-15, the two headboard units 28 placed side by side comprise the king-size headboard unit 84 having a first end 67 and a second end 69. As shown in FIG. 14, the bottom end 98 of the modular king-size bedroom system 100 includes two drawer units 92 side by side: one from the modular twin-size bedroom system 10 and the other from the mirror image of the modular twin-size bedroom system 10. As shown in FIGS. 12, 13 and 15, the modular king-size bedroom system 100 contains two recessed areas 74, which provide entrance onto the bed floor 99 from either side of the bedroom system 100. In addition, two sets of step units 70, one on either side of the modular king-size bedroom system 100, allow a user to ascend to the recessed area 74 on either side of the modular king-size bedroom system 100 (best shown in FIG. 15).

The bed floor 99 includes two sets of a plurality of ledges 97, one set positioned on each end of the bed floor 99. Each of the plurality of ledges 97 in each set has an interior therein and a movable panel attached to the ledge 97, wherein the movable panel allows access and covers the interior of the ledge 97. Also included on the bed floor 99 is a mattress keeper 88 configured to keep a king-size or California king-size mattress 87 stationary and to prevent the mattress 87 from sliding on the bed floor 99.

The invention contemplates other embodiments comprising other arrangements of the desk units and the closet units, namely, placing a desk unit adjacent to and attached to another desk unit, placing a closet unit adjacent to attached to another closet unit, or placing a closet unit at the top end and a desk unit at the bottom end of the modular bedroom system.

The invention also contemplates that the individual units of the modular bedroom system are manufactured from suitable materials typically used for furniture manufacturing, including, without limitation, different types of wood, wood composites and the like.

The invention further contemplates that one skilled in the art would know how to attach each of the units to one another in order to build either the smaller, twin-size bedroom system or the larger, king-size bedroom system Additionally, the invention is not limited to these two sized bedroom systems, as changes to the dimensions of the desk units, the closet units, and the drawer units can result in bed floors that fall in-between a twin-size bed floor and a king-size or California king-size bed floor. Thus, the invention is not limited to particular dimensions, particular materials, or to particular arrangements of the desk units and the closet units.

It will be appreciated by those skilled in the art that changes could be made to the embodiments described above without departing from the broad inventive concept thereof. It is understood, therefore, that this invention is not limited to the particular embodiments disclosed, but is intended to cover modifications that are within the spirit and scope of the invention, as defined by the appended claims.

What is claimed is:

1. A modular twin-size bedroom system, comprising a plurality of units, wherein each of the plurality of units are adjacent to and attached to another one of the plurality of units, wherein the plurality of units comprises a closet unit having a first side, a second side, a back side, a top side, and a desk opening therein, a desk unit having a first side, a second side, a back side, a top side, and a desk opening therein, a drawer unit having a front end, a top end, a first end, a second end, and a back end, said drawer unit having a plurality of drawers atop one another on the front end, a headboard unit having a front end, a first end, a second end, and a back end, and a bed floor, wherein the modular twin-size bedroom system has a first end, a second end, a top end, and a bottom end, wherein the first side of the desk unit is attached to the second side of the closet unit, the back end of the drawer unit is attached to the first side of the closet unit, and the headboard lies atop the desk unit and is attached thereto.

2. The modular twin-size bedroom system of claim 1, wherein a front end of the modular bedroom system is comprised of the desk unit, the second side of the headboard unit, the closet unit, the second end of the drawer unit, and the step unit.

3. The modular twin-size bedroom system of claim 1, further comprising a rollable door attached to a set of rollers, said set of rollers movable along a channel located at the top of the closet opening and the desk opening, said rollers configured for moving the door horizontally back and forth.

4. The modular twin-size bedroom system of claim 1, wherein the desk unit contains a plurality of shelves and a desk-top, wherein the closet unit contains a plurality of shelves and a moveable clothes rack having two ends, wherein rollers are attached at one end of the clothes rack and the other end of the clothes rack is attached to a rollable channel located at the top side of the closet.

5. The modular twin-size bedroom system of claim 1, wherein the bed floor is comprised of the top sides of the desk unit, the closet unit and the drawer unit, said bed floor configured to accommodate a bed mattress, wherein the drawer unit has a recessed area atop the second end of the drawer unit which allows entry onto the bed floor.

6. The modular twin-size bedroom system of claim 1, wherein a plurality of ledges is located along one end of the bed floor, each of said plurality of ledges having an interior therein and a movable panel attached to the ledge, wherein the moveable panel allows access and covers the interior.

7. The modular twin-size bedroom system of claim 1, wherein the front end of the headboard unit has a recess in the center and two movable panels on either side of the recess.

8. The modular twin-size bedroom system of claim 1, wherein a plurality of electrical sockets each is positioned in the closet unit, the desk unit and near the front end of the headboard unit.

9. A modular king-size bedroom system, comprising the modular twin-size bedroom system of claim 1 and a mirror image of the modular twin-size bedroom system, wherein the back end of the modular twin-size bedroom system is placed adjacent to and attached to the back end of the mirror image of the modular twin-size bedroom system.

10. The modular twin-size bedroom system of claim 1, further comprising a step unit comprised of a plurality of rectangular boxes placed atop one another, said plurality of rectangular boxes having one or more open sides, wherein the step unit is adjacent to the second end of the drawer unit.

11. The modular king-size bedroom system of claim 10, wherein one of the step units allows a user to ascend to one of the recessed areas and the other step unit allows the user to ascend to the other recessed area.

12. The modular king-size bedroom system of claim 11, wherein the first end of the two headboard units, the top portion of the back end of the closet units, and the top portion of the first end of the drawer units are removed from each of the modular twin-size bedroom systems, said removal providing a king-size bed floor having a first end and a second end.

13. The modular king-size bedroom system of claim 12, wherein the modular king-size bedroom system has a top end, a bottom end, a first end and a second end.

14. The modular king-size bedroom system of claim 13, wherein the bottom end comprises two drawer units comprised of the drawer unit from the modular twin-size bedroom system and the drawer unit from the mirror image of the modular twin-size bedroom system.

15. The modular king-size bedroom system of claim 12, wherein the recessed area contained in each of the two drawer units provides two entries onto the bed floor.

16. The modular king-size bedroom system of claim 12, wherein one set of a plurality of ledges are located along the first end of the bed floor and a second set of a plurality of ledges are located along the second end of the bed floor, each of the plurality of ledges in each set having an interior therein and a movable panel attached to the ledge, wherein the movable panel allows access and covers the interior.

17. The modular king-size bedroom system of claim 12, wherein a king-size or a California king-size bedroom mattress is positioned on the bed floor.

18. The modular king-size bedroom system of claim 17, wherein a mattress keeper is located on the bed floor and is configured to keep the king-size or California king-size mattress stationary and prevent sliding of the mattress on the bed floor.

* * * * *